US007908879B1

(12) United States Patent
Chen

(10) Patent No.: US 7,908,879 B1
(45) Date of Patent: Mar. 22, 2011

(54) MULTIFUNCTIONAL CEILING AIR-CONDITIONING CIRCULATION MACHINE

(76) Inventor: Yung-Hua Chen, Lujhou (TW)

( * ) Notice: Subject to any disclaimer, the term of this patent is extended or adjusted under 35 U.S.C. 154(b) by 0 days.

(21) Appl. No.: 12/588,947

(22) Filed: Nov. 3, 2009

(51) Int. Cl.
*F25D 23/12* (2006.01)

(52) U.S. Cl. ..... 62/259.1; 62/285

(58) Field of Classification Search ..... 62/259.1, 62/285, 291, 126, 419, 414, 314; 248/370, 248/647; 415/98, 173.6, 219.1; 417/96, 417/423.14, 424.1; 454/41, 354, 349; 165/122, 165/123, 125
See application file for complete search history.

(56) References Cited

U.S. PATENT DOCUMENTS

| | | | | |
|---|---|---|---|---|
| 4,958,500 | A * | 9/1990 | Kuroda et al. | 62/89 |
| 5,958,114 | A * | 9/1999 | Sunahara et al. | 96/417 |
| 6,460,364 | B1 * | 10/2002 | Tufo | 62/285 |
| 6,520,247 | B2 * | 2/2003 | Hultmark | 165/56 |
| 7,204,096 | B2 * | 4/2007 | Iwata et al. | 62/426 |
| 7,497,246 | B2 * | 3/2009 | Sakashita et al. | 165/53 |
| 7,571,785 | B2 * | 8/2009 | Ferdows | 180/68.1 |
| 7,614,246 | B2 * | 11/2009 | Yabu et al. | 62/259.1 |
| 2001/0054493 | A1 * | 12/2001 | Hatanaka | 165/53 |
| 2004/0079094 | A1 * | 4/2004 | Kasai et al. | 62/186 |
| 2006/0070658 | A1 * | 4/2006 | Nakata et al. | 137/312 |
| 2007/0066215 | A1 * | 3/2007 | Song et al. | 454/329 |
| 2007/0113527 | A1 * | 5/2007 | Song et al. | 55/471 |
| 2008/0035317 | A1 * | 2/2008 | Choi et al. | 165/122 |
| 2009/0007580 | A1 * | 1/2009 | Sakashita et al. | 62/259.1 |
| 2009/0098820 | A1 * | 4/2009 | Yabu | 454/333 |
| 2009/0165432 | A1 * | 7/2009 | Yabu et al. | 55/415 |
| 2010/0010680 | A1 * | 1/2010 | Nishino et al. | 700/282 |
| 2010/0233952 | A1 * | 9/2010 | Mavroudis et al. | 454/275 |

FOREIGN PATENT DOCUMENTS

JP 2001324191 A * 11/2001

OTHER PUBLICATIONS

Abstract of JP 2001-324191 A to Satoshi et al.*

* cited by examiner

*Primary Examiner* — Mohammad M Ali
(74) *Attorney, Agent, or Firm* — Rosenberg, Klein & Lee

(57) ABSTRACT

A multifunctional ceiling air-conditioning circulation machine includes a base having a square fixing frame mounted around the periphery of the base and a concave circular groove formed at the middle of the base, a circular evaporator installed on the concave circular groove, a fan installed in the evaporator, and a water pump installed in an extended area on an external side of the concave circular groove for discharging condensate water dripped from the evaporator to the concave circular groove to the outside through a drain pipe. The machine integrates the multiple of functions including a circulation fan, an air conditioner, an air guide and an air re-circulation into the machine mounted onto a ceiling or a light steel frame.

10 Claims, 14 Drawing Sheets

MULTIFUNCTIONAL CEILING AIR-CONDITIONING CIRCULATION MACHINE

BACKGROUND OF THE INVENTION

1. Field of the Invention

The present invention relates to a multifunctional ceiling air-conditioning circulation machine, and more particularly to an all-in-one machine with the functions of a circulation fan, an air-conditioner, an air box, an air duct, an air outlet, a re-circulation outlet, and an air filter/purifier.

2. Description of the Related Art

When offices or factories are interiorly decorated, the ceiling is often made by light steel frame in a grid shape. Thereafter, the ceiling is placed in the grid frame. This kind of the construction way is simple and has low cost. Thus, it is widely used.

In order to enhance the convection of the indoor air, an air-conditioning circulation machine or a fan is often placed into the grid frame. As shown in FIG. 1, a circulation fan 12 extra for a ceiling steel frame is installed at the bottom of an upper housing 11. A lower housing 13 includes an air outflow hole 14 formed in a circular shape and corresponding to the circulation fan 12. An air outflow disc 15 is positioned within the air outflow hole 14 such that the air is expelled from the air outflow disc 15 when the air is sucked from an air inflow opening 16 at the rim of the lower housing 13. In this way, an increased convection of the indoor air is guaranteed.

In general, a conventional circulation fan 10 simply has the ventilation and air blowing functions and does not come with an air-conditioning function, and thus it is necessary to install an air-conditioning blower 20 as shown in FIGS. 2A and 2B on a ceiling or a steel frame, and the air-conditioning blower 20 comprises an air blower 21, an evaporator 22, an air collection box 23, an air duct 24, an air outlet 25 and a re-circulation outlet 26, wherein the evaporator 22 is provided for absorbing heat to produce an expansion effect by a high-pressure refrigerant from a compressor 27, and the air blower 21 sucks cold air around the evaporator 22 into the air collection box 23 from the rear direction, and the air duct 24 sends the cold air to each room A, B, C . . . N However, the manufacture and application of the aforementioned air-conditioning blower 20 still have the following drawbacks:

1. The conventional air-conditioning blower 20 usually supplies cold air to several rooms A, B, C . . . N at the same time, and thus it is necessary to adopt a high-power machine. Such arrangement not only results in a large volume only, but also results in a heavy weight of the machine, so that it is very difficult to hang and install such machine on the ceiling.

2. The conventional air-conditioning blower 20 sends cold air through the air duct 24, but some rooms far from the air collection box 23 require a very long air duct 24. Such arrangement not only incurs a higher material cost, but also incurs a higher loss of cold air as well as affecting the air-conditioning effect.

3. To have a balanced air pressure for each room A, B, C . . . N, it is necessary to have air inlets and re-circulation outlets 26 at many places of the ceiling. Such arrangement not only affects the aesthetic appearance, but also increases the cost.

In view of the aforementioned drawbacks, the inventor of the present invention conducted extensive researches and experiments, and finally developed a multifunctional ceiling air-conditioning circulation machine in accordance with the present invention to overcome the shortcomings of the prior art.

SUMMARY OF THE INVENTION

A primary object of the present invention is to provide a multifunctional ceiling air-conditioning circulation machine that integrates the functions of a circulation fan, an air conditioner, an air guide and an air re-circulation into the machine to be mounted on a ceiling or a steel frame, and a standalone air conditioner is installed in each small area of the ceiling, so that the volume and the weight of the machine can be minimized, not just facilitating the construction only, but also allowing a flexible way of installing the air conditioners at different positions of the ceiling as needed, and overcoming the loss of cold air due to a too-long air duct, so as to achieve the effects of a convenient installation and improve the efficiency of supplying cold air.

Another object of the present invention is to provide a multifunctional ceiling air-conditioning circulation machine having a filter installed on a re-circulation outlet to provide the function of an air purifier.

In order to achieve the above-mentioned objects, the invention includes:

a) a base, having a square fixing frame formed around the periphery of the base, a concave circular groove formed at the center of the base, a plurality of exhaustion outlets formed between an internal side of the square fixing frame and an external side of the concave circular groove, and a plurality of ribs formed at the center of the circular hole on an internal side of he concave circular groove for supporting the fan holder;

b) an evaporator, substantially in a circular shape, and installed on the concave circular groove;

c) a fan, installed in the evaporator, and comprised of a motor and a fan vane, wherein the motor is mounted onto the fan holder, and the fan vane is installed in a direction facing upward;

d) a water pump, installed in an extended area on an external side of the concave circular groove, for discharging condensate water dripped from the evaporator to the concave circular groove through a drain pipe to the outside;

e) a cover, covered onto the square fixing frame of the base; and f) a controller, including a control unit and wireless signal receiver, wherein the control unit is electrically coupled to the fan and the water pump for controlling the fan and the water pump to be turned ON or OFF.

BRIEF. DESCRIPTION OF THE FIGURES

DETAILED DESCRIPTION OF THE PREFERRED EMBODIMENT

Figure 3:
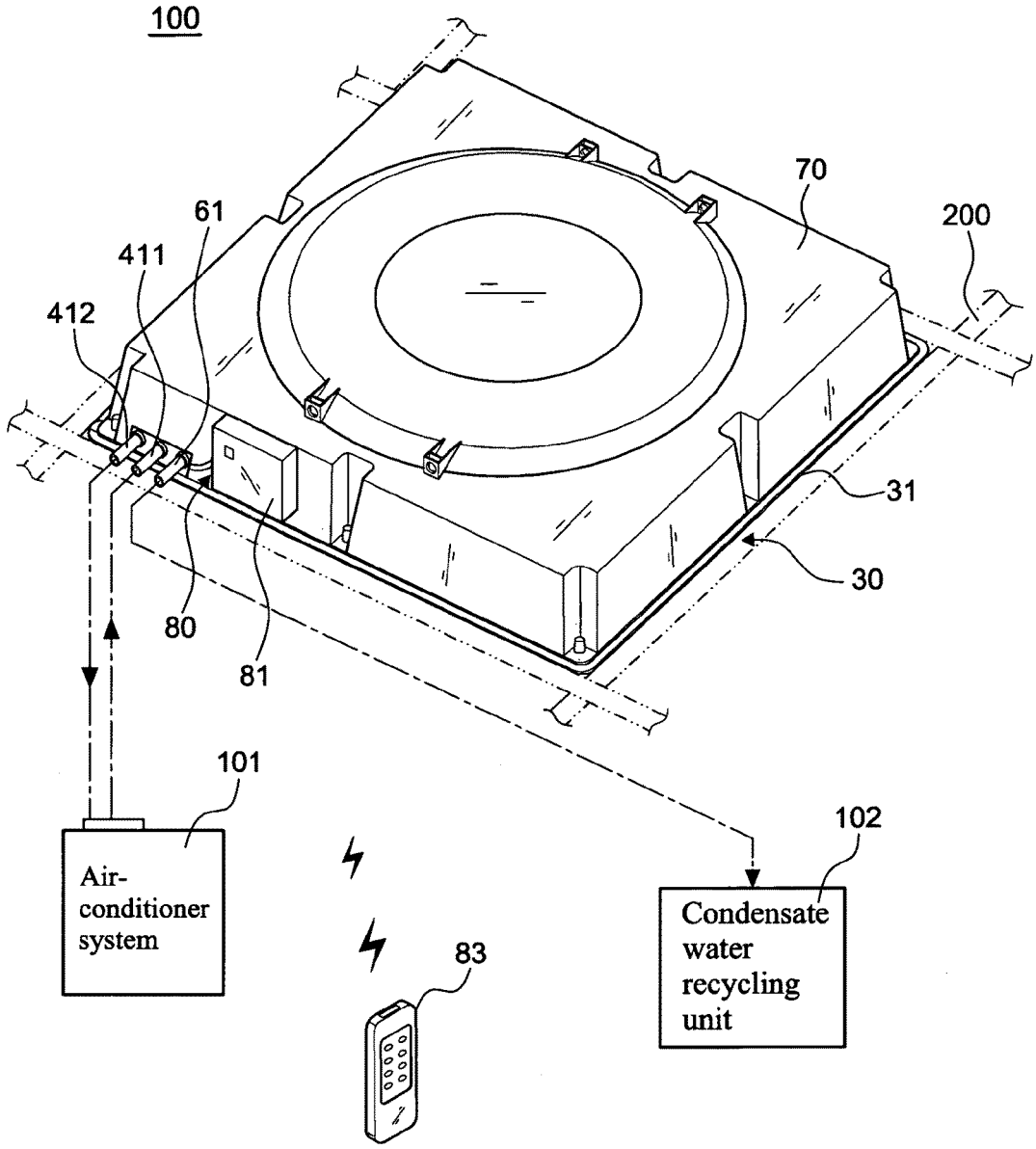
FIG. 3 is a perspective top view of a preferred embodiment of the present invention.
Figure 4:
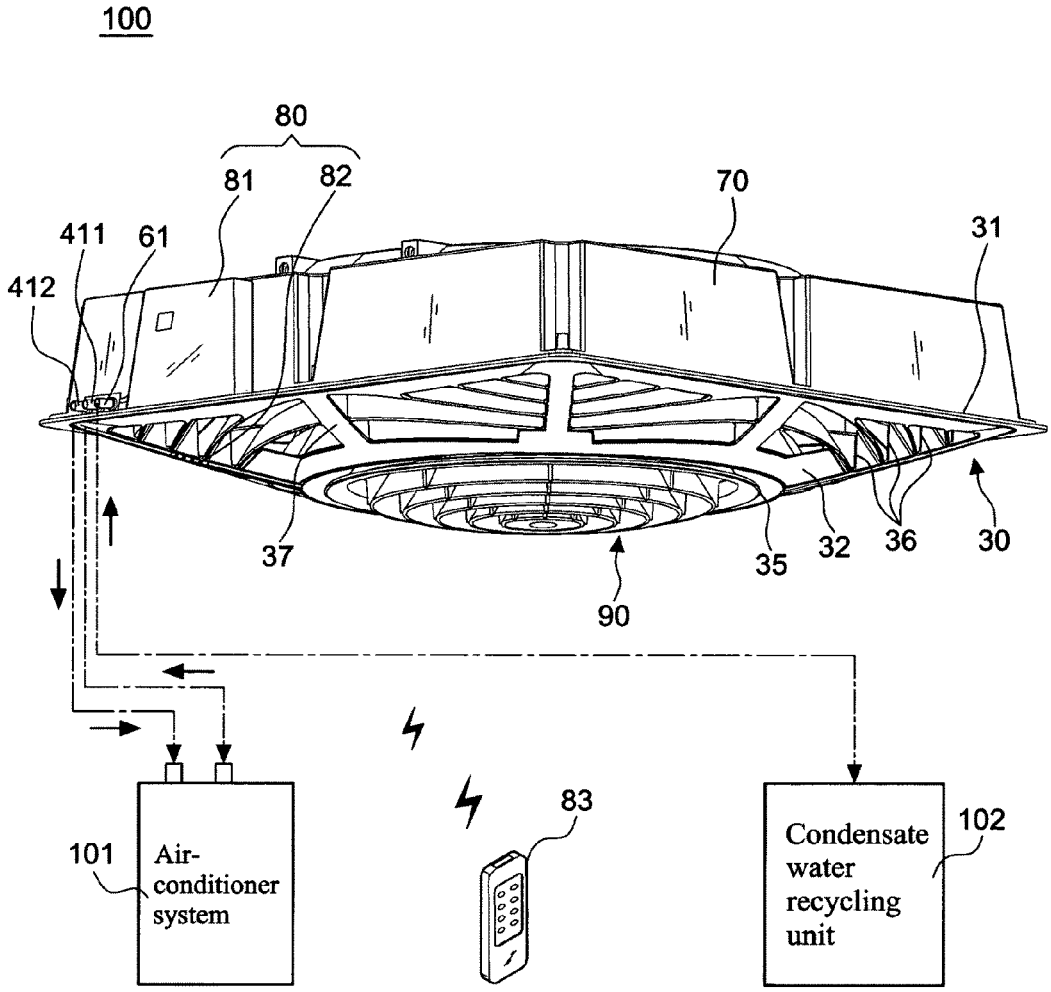
FIG. 4 is a perspective bottom view of a preferred embodiment of the present invention.
Figure 13:
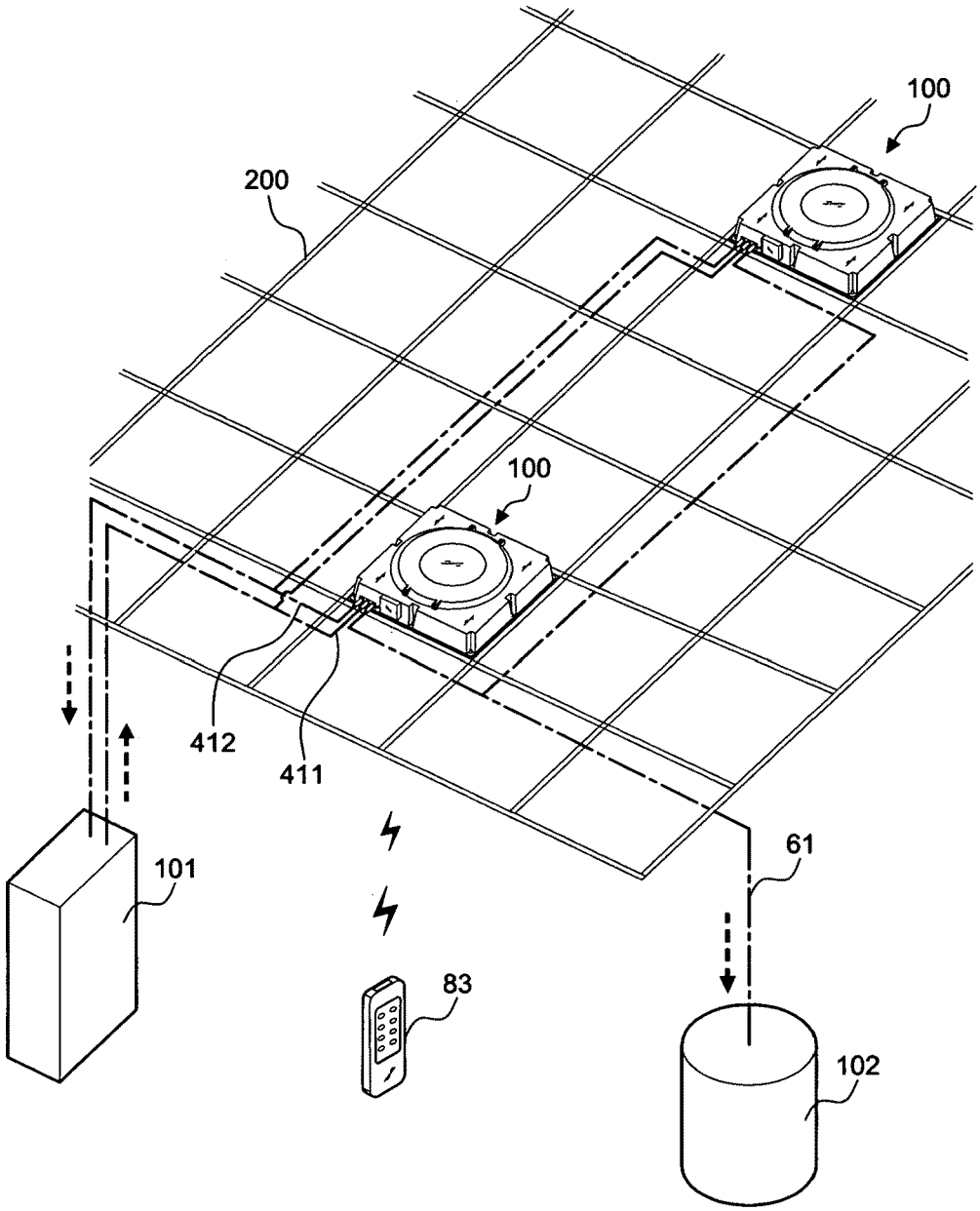
FIG. 13 is a schematic view of an application of the present invention.

With reference to FIGS. 3 to 12 for a multifunctional machine 100 installed on a steel frame or a ceiling 200 in accordance with a preferred embodiment of the present invention, the machine 100 comprises the following components:

A base 30 includes a square fixing frame 31 formed around the periphery of the base 30 for facilitating mounting the base onto a steel frame or a square frame of a ceiling 200 as shown in FIGS. 3 and 13 respectively, and the fixing frame 31 includes a plurality of radial support frames 37 extended inwardly from the periphery of the fixing frame 31, a plurality of exhaustion outlets 36 formed between an internal side of the fixing frame 31 and an external side of the concave circular groove 32, and a plurality of ribs 33 formed at the center of the circular hole 35 on the internal side of the concave circular groove 32 for supporting the fan holder 34, and the concave circular groove 32 of this embodiment has an U-shaped cross-section opened upward.

Figure 6:
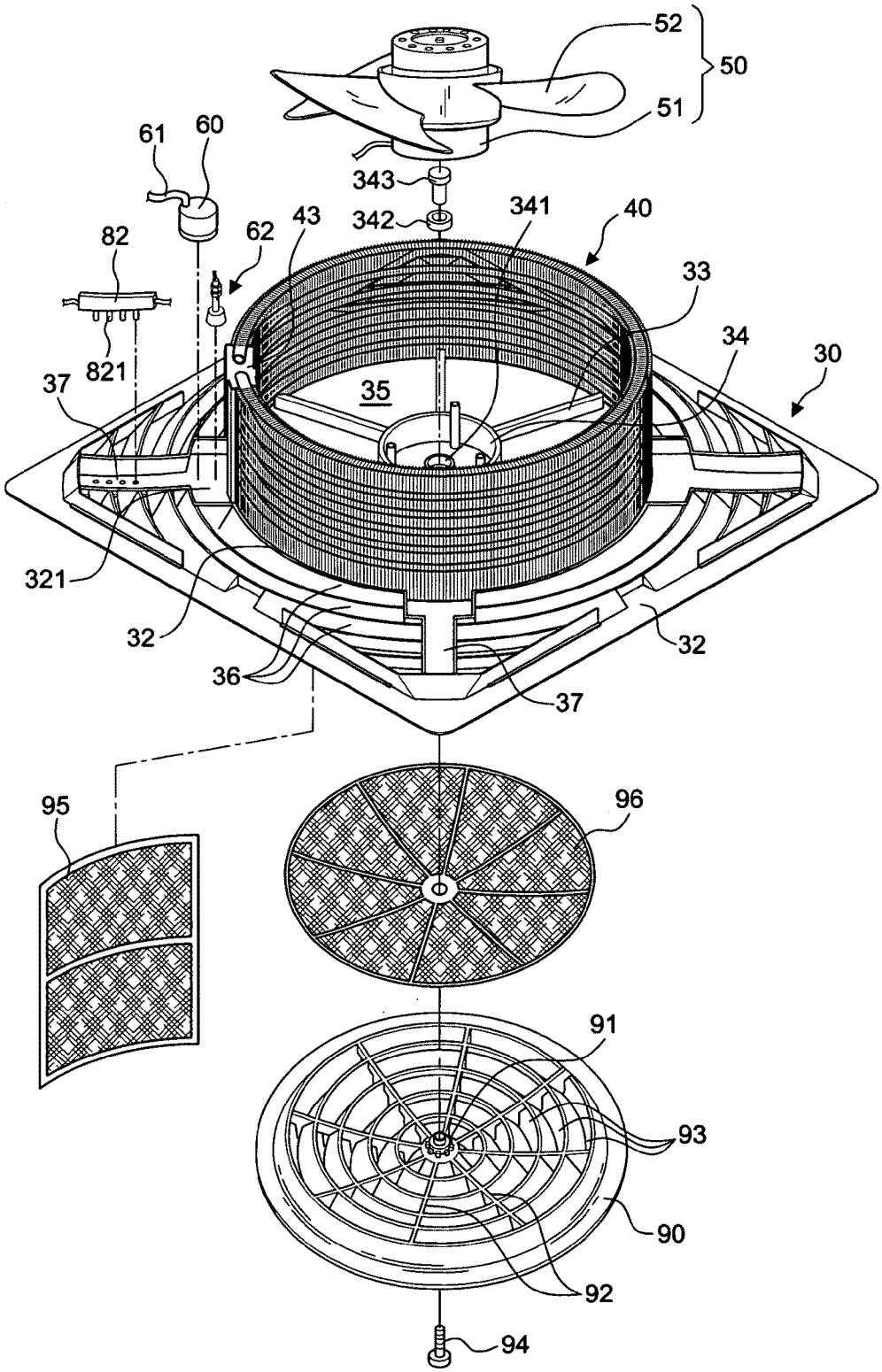
FIG. 6 is an exploded view of some components of a preferred embodiment of the present invention.
Figure 7:
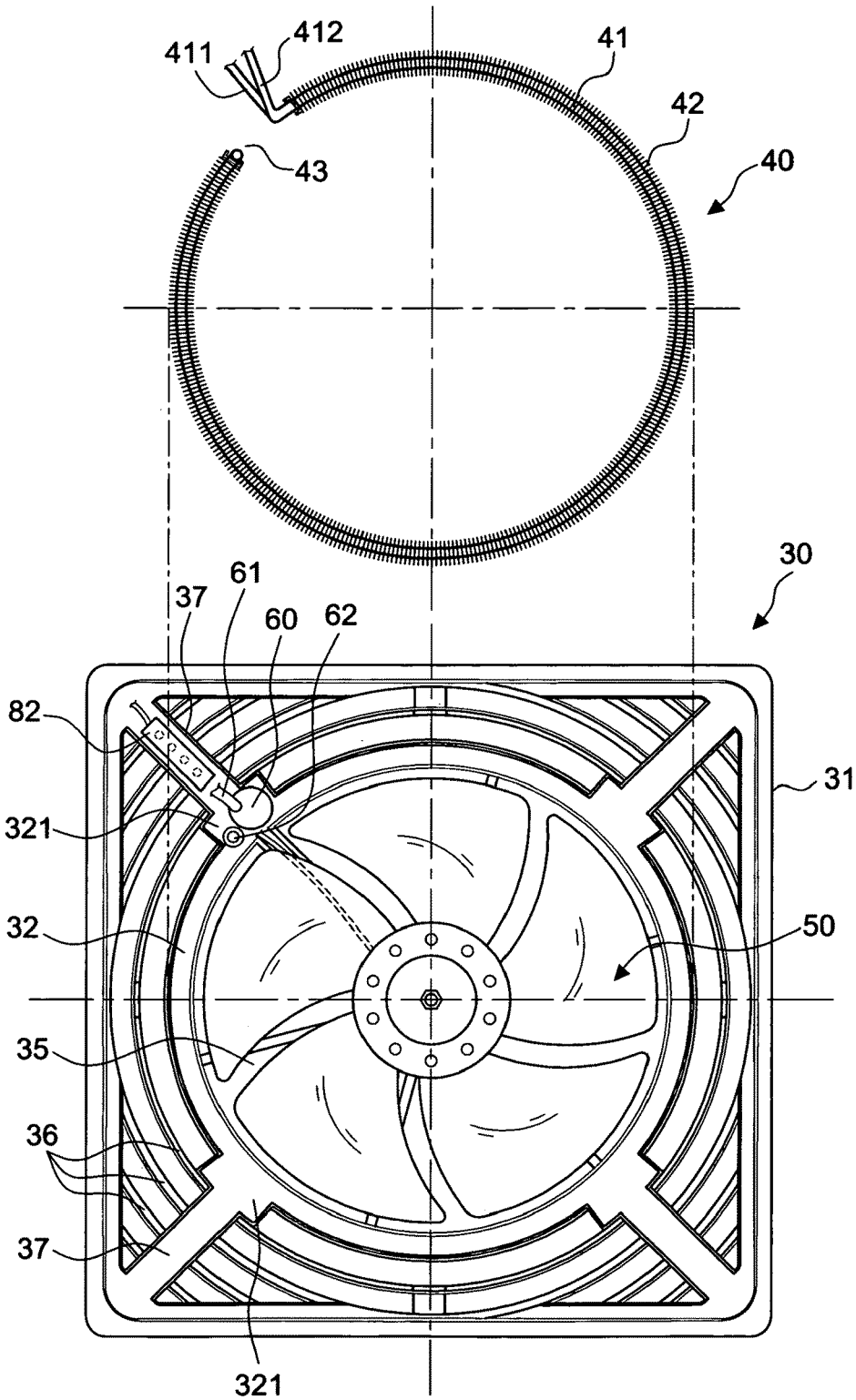
FIG. 7 is a top view of a condenser separated from a base in accordance with a preferred embodiment of the present invention.
Figure 8:
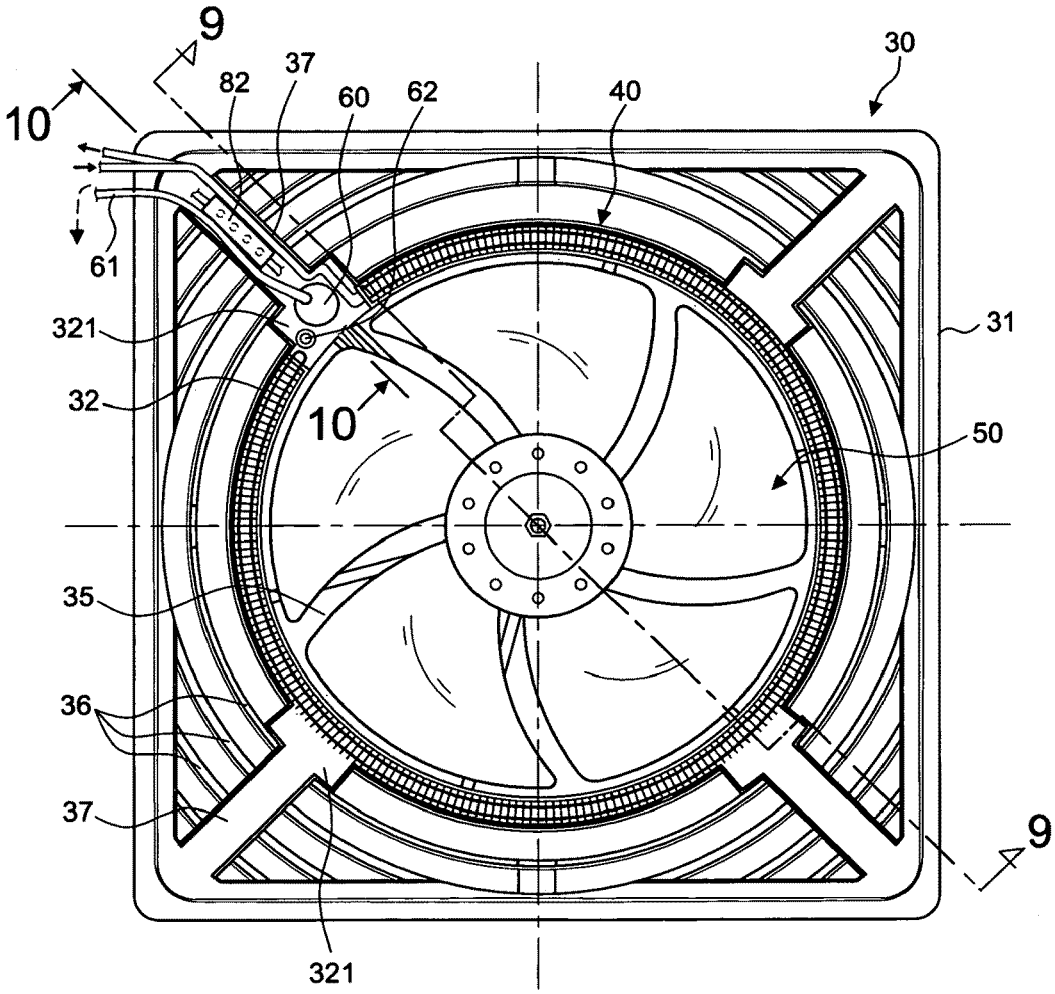
FIG. 8 is a top view of a condenser combined with a base in accordance with a preferred embodiment of the present invention.

An evaporator 40 is substantially in a circular shape and installed on the concave circular groove 33. In other words, the evaporator 40 is installed into the concave circular groove 32 and comprises a circulation pipe 41 and a plurality of heat dissipating fins 42 passed thereon. Since the evaporator 40 is a prior art, therefore its operating principle will not be described here, and the present invention is characterized in that the evaporator 40 is a circular body as shown in FIGS. 6 and 7, and the circular body has a gap 43, such that the circulation pipe 41 can be connected to an input pipe 411 and a re-circulation pipe 412 to an exterior of the machine 100 through the gap 43 to facilitate connecting an air-conditioner system 101 at a far end. In this embodiment, the evaporator 40 is an integrally formed circular body, but the invention is not limited to such arrangement only, and the invention may adopt a plurality of circular bodies.

A fan 50 is installed in the evaporator 40 and comprised of a motor 51 and a fan vane 53, wherein the motor 51 is mounted onto the fan holder 34, and the fan vane 52 is installed in a direction facing upward.

Figure 10:
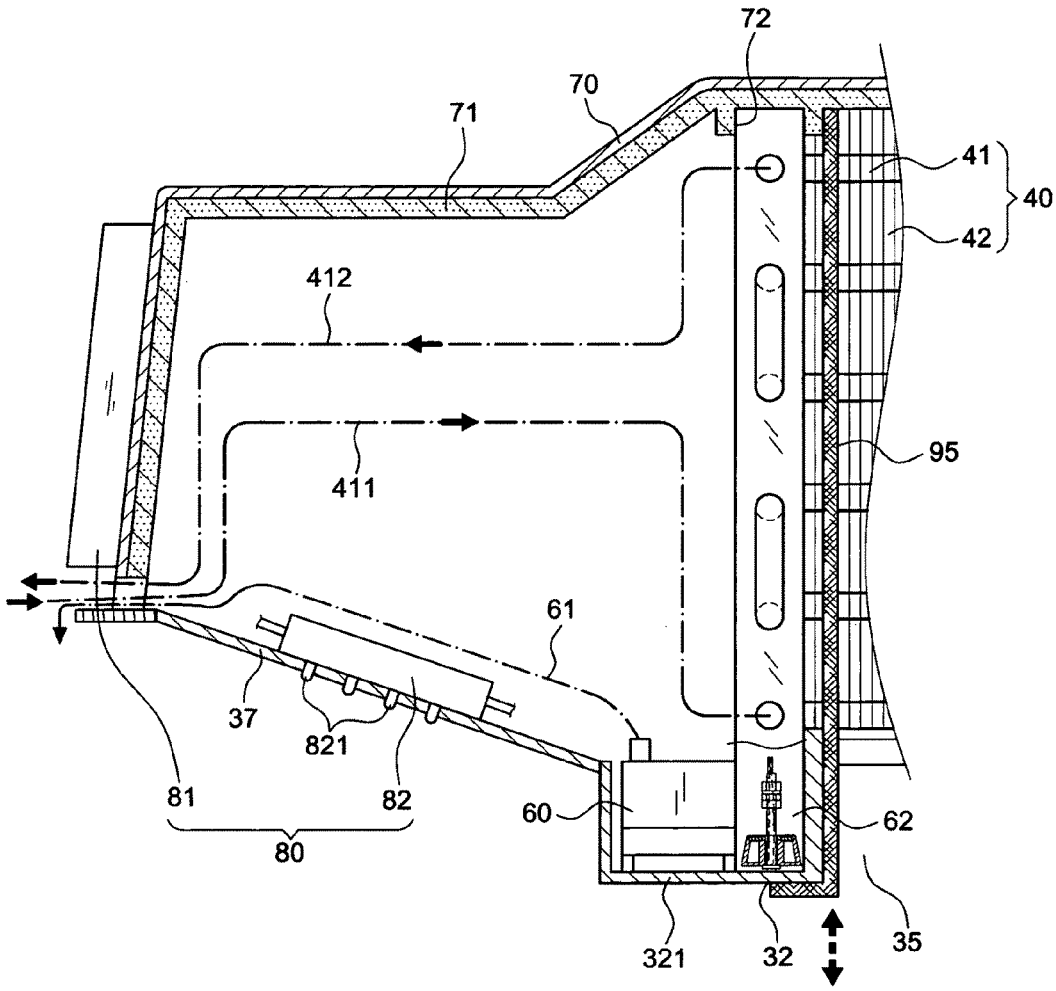
FIG. 10 is a cross-sectional view of Section 10-10 of FIG. 8.
Figure 11:
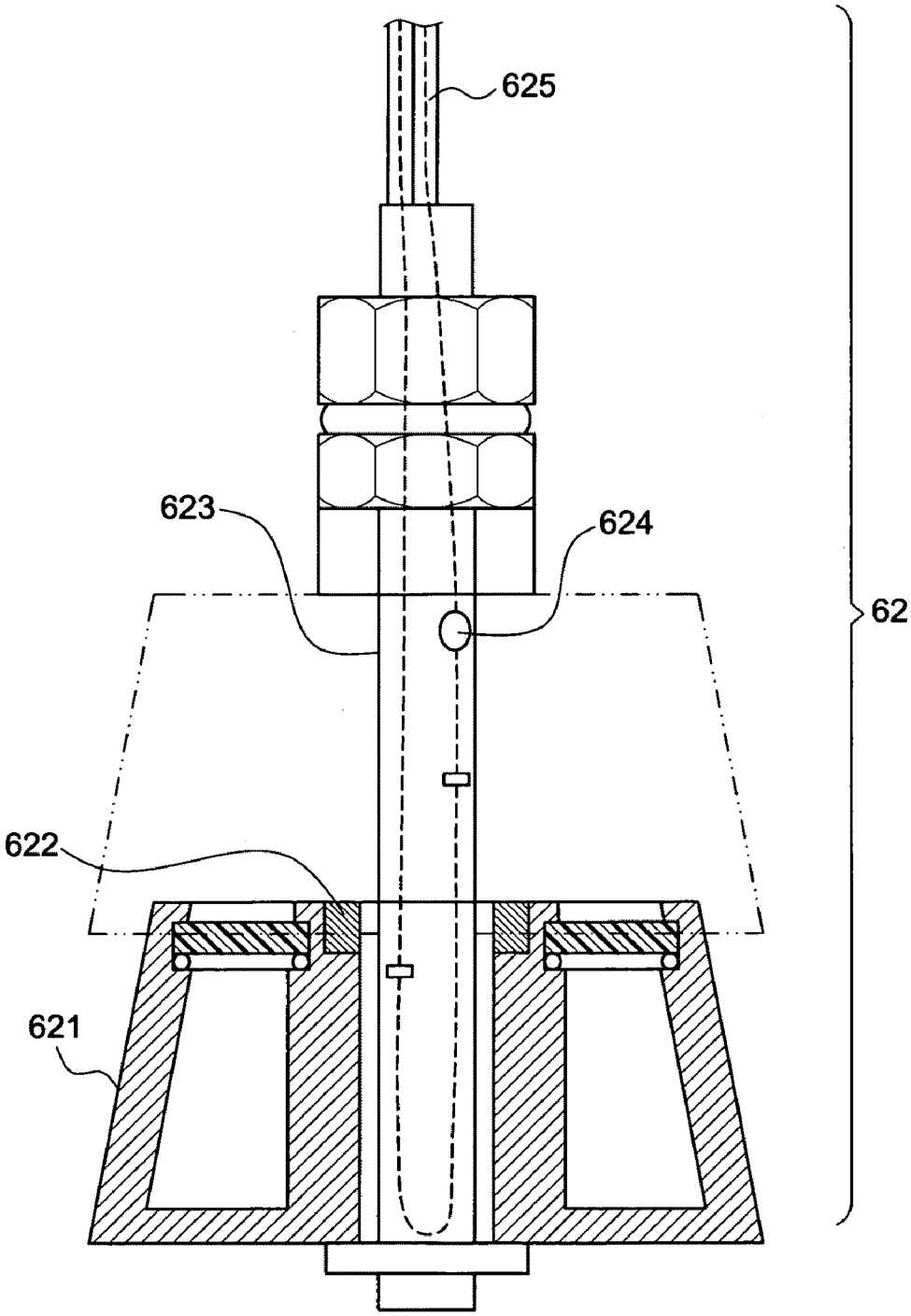
FIG. 11 is a schematic view of a liquid level detector of the present invention.

A water pump 60 is installed in an extended area 321 on an external side of the concave circular groove 32 for discharging condensate water dripped from the evaporator 40 to the concave circular groove 32 through a drain pipe 61 to a condensate water recycling unit 102 installed externally. In this embodiment, the water pump 60 includes a liquid level detector 62 installed on a side of the water pump 60 in accordance with a preferred embodiment as shown in FIGS. 10 and 11, and the liquid level detector 62 includes a buoy 621 that can be displaced on a shaft lever 632 according to a change of water level, and a magnet 622 installed in the buoy 621 and a reed switch 624 installed at a position of the shaft lever 623 and opposite to the magnet 622. In other words, if the condensate water in the concave circular groove 32 has reached a predetermined height, the buoy 621 will rise and the magnet 622 will induce the reed switch 624, such that a detection signal is transmitted through a conductive wire 625 to turn on the water pump 60 to discharge the condensate water through the drain pipe 61 to the outside. If the present invention does not have a water pump 60, then the condensate water produced by the evaporator 40 will be accumulated and then overflown from the concave circular groove 32. To accommodate and install the water pump 60, it is necessary to have an extended area 321 on the external side of the concave circular groove 32, wherein the extended area 321 slightly wider than the concave circular groove 32 is provided for allowing pumped water to be entered into the water pump 60.

A cover 70 is covered onto the square fixing frame 31 of the base 30, and the cover 70 includes an insulating layer 71 on an internal side of the cover 70, wherein the insulating layer 71 is formed by polyfoam, so that the cold air produced by the evaporator 40 can be kept in the cover 70 to prevent condensate water from dripping from an external surface of the cover 70.

Figure 12:
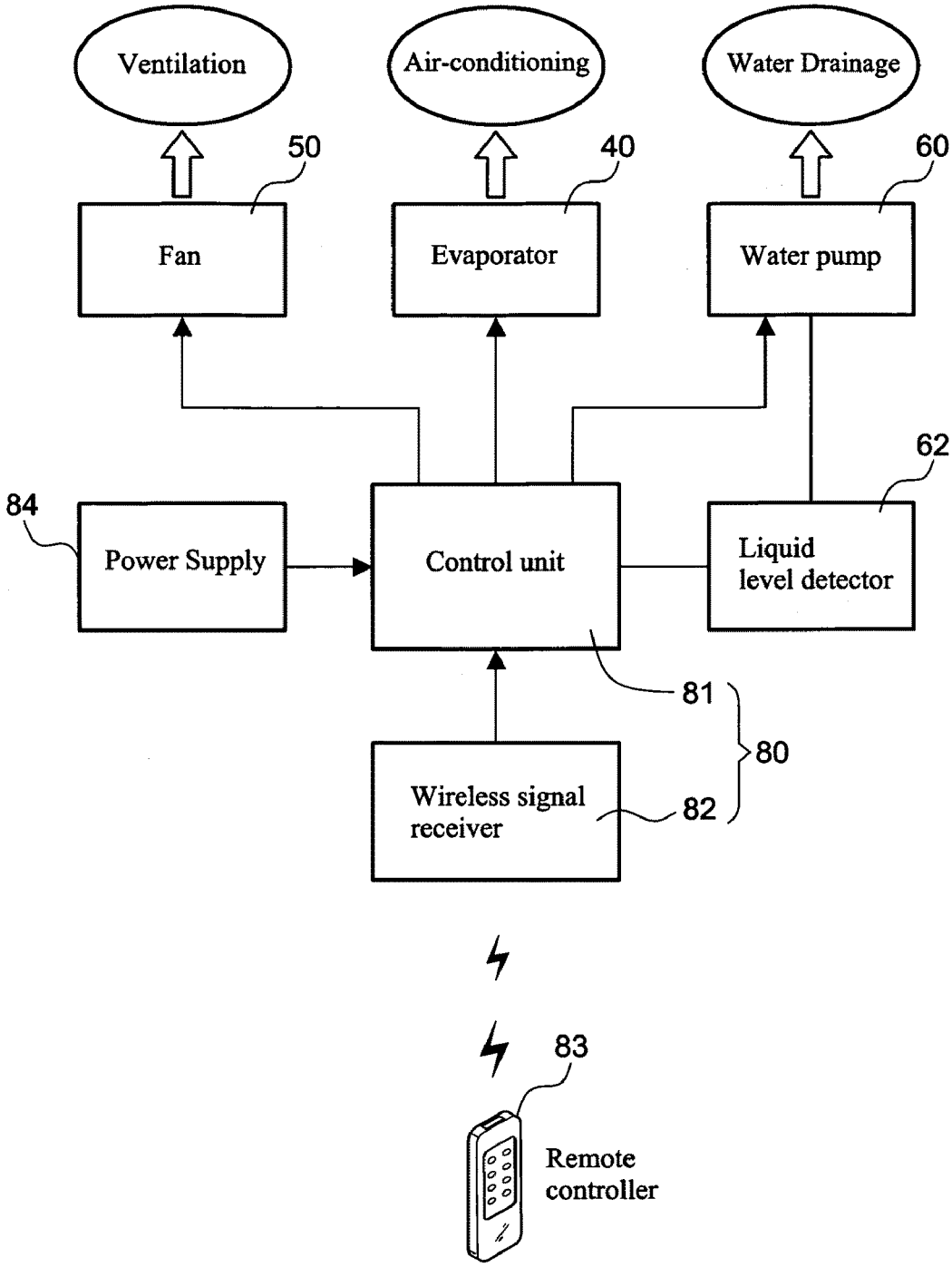
FIG. 12 is a schematic circuit diagram of a control circuit of the present invention.

A controller 80 includes a control unit 81 and a wireless signal receiver 82, wherein the control unit 81 is electrically coupled to the fan 50 and the water pump 60 for controlling the fan 50 and the water pump 60 to be turned ON or OFF. The wireless signal receiver 82 is installed on the base 30, and particularly at a position on the radial support frame 37 in this preferred embodiment, and the displaying lamp 821 is exposed form the bottom of the base 30, such that when a user operates a remote controller 83 under the ceiling, a better receiving effect can be achieved, and a displaying lamp can be observed. In addition, the control unit 81 such as a circuit board is installed in a casing and on an external side of the cover 70, and electrically coupled to a wireless signal receiver 82 on the base 30 in accordance the present invention. If the wireless signal receiver 82 receives a signal of the remote controller 83, then the control unit 81 will turn on or off the fan 50. As to the water pump 60 as shown in FIG. 12, the control unit 81 is operated to obtain a power supply 84, and then the liquid level detector 62 is used for controlling the water pump 60 to be turned ON/OFF to discharge the condensate water timely. In addition, the evaporator 40 is connected to the air-conditioner system 101, so that the air-conditioner system 101 can be turned off individually. Of course, the control unit 81 can be electrically coupled to the air-conditioner system 101, so that the remote controller 83 can be used to turn on or off air-conditioner system 101 through the controller 80.

Figure 5:
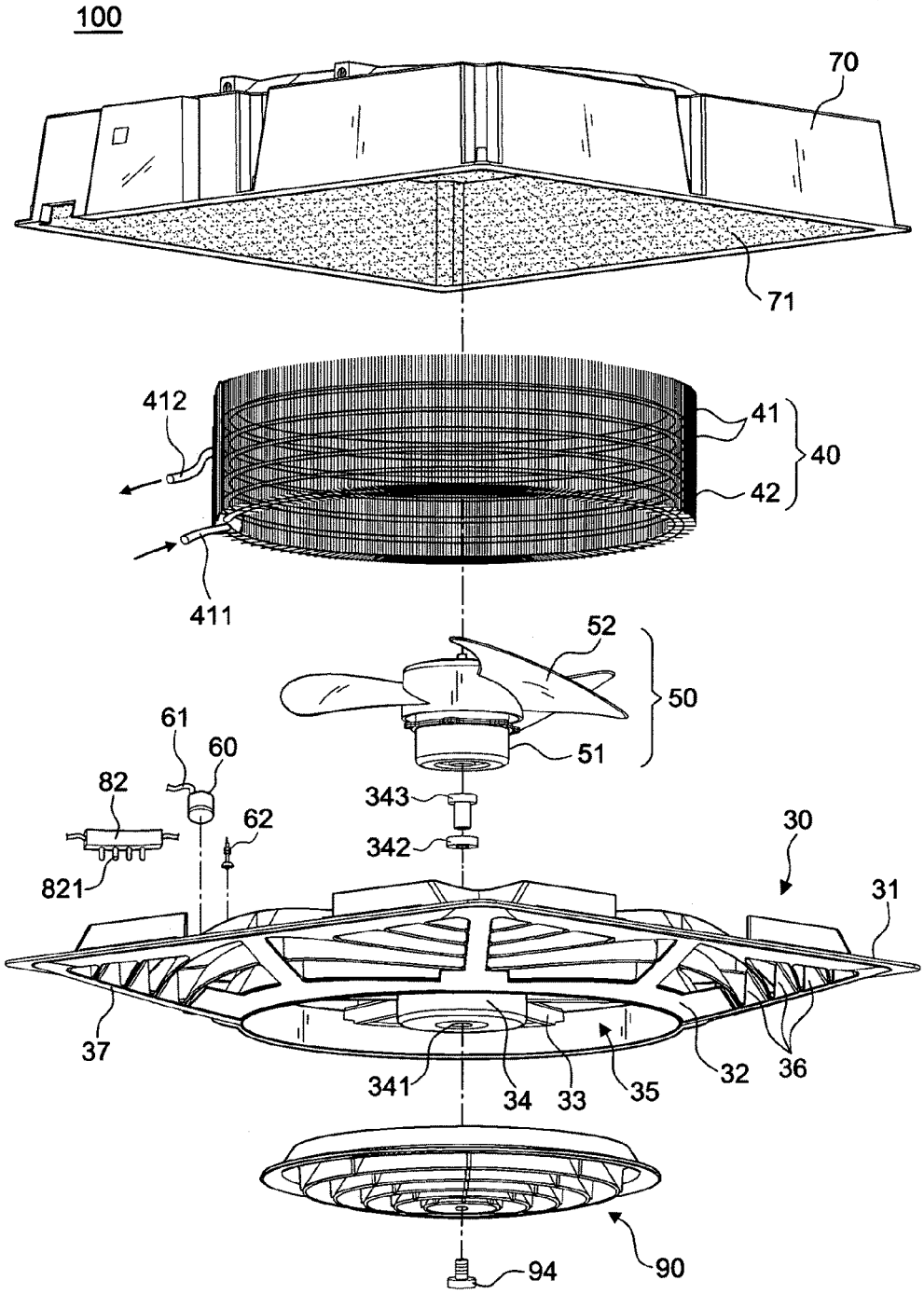
FIG. 5 is an exploded view of a preferred embodiment of the present invention.
Figure 9:
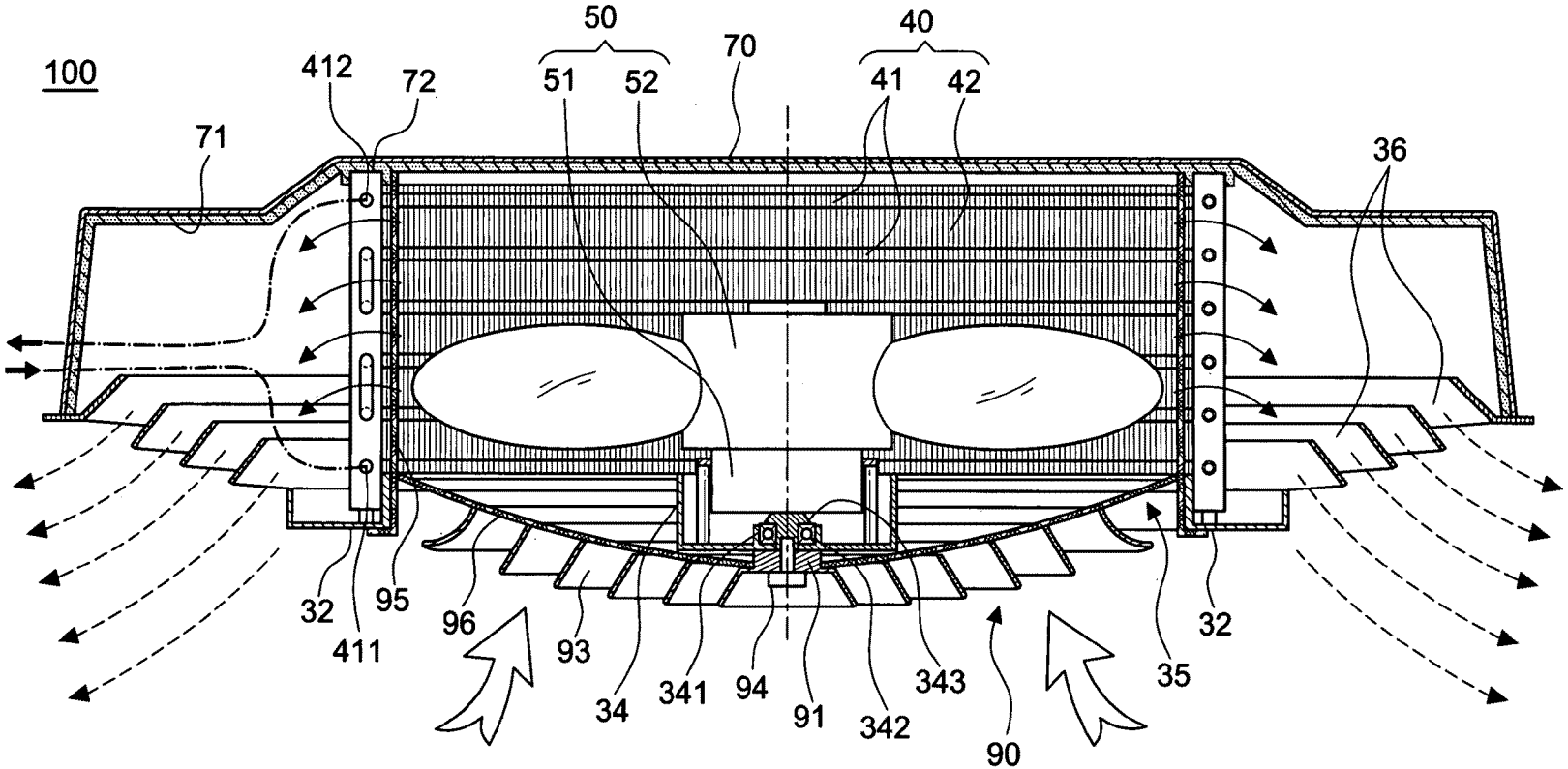
FIG. 9 is a cross-sectional view of Section 9-9 of FIG. 8.

With reference to FIGS. 5, 6 and 9, the fan holder 34 of the present invention includes a bearing housing 341 at the center of the bottom of the fan holder 34, a bearing 342 and an axle 343 installed on the bearing housing 341, and a guide disc 90 is installed from bottom to top into the circular hole 35 of the concave circular groove 32, and a joint portion 91 is disposed at the center of the guide disc 90 and opposite to the axle 343, and a bolt 94 is used for fixing the guide disc 90 to the bottom of axle 343 in a bottom-to-top direction, so that the guide disc 90 can be rotated freely under the fan holder 34. In addition, the guide disc 90 includes a plurality of radial partitioning plates 92 and a plurality of concentric conical circular air guide plates 93 extended outwardly from the center of the joint portion 91, wherein each air guide plate 93 is a through hole, and each conical circular air guide plate 93 is arranged with the middle protruded downwardly and the external periphery raised progressively to form an upwardly curved arc shape. In the design of the guide disc 90 in accordance with the present invention, the fan 50 is rotated for sucking air to form an air flow in the circular hole 35. Now, a force exertion surface of the air flow is formed at a vertical plane of a side of each radial partitioning plate 92, and the joint portion 91 is used as the center of axis for a slow rotation. In other words, the guide disc 90 will be rotated in the same direction of the fan 50 without the need of installing a driving motor at an edge of the guide disc 90. The invention constitutes a structure without a motive power source and achieves the self-rotation and air guide effects.

The guide disc 90 further includes a circular filter 96 mounted onto an internal surface of the guide disc 90, so that dusts in the air can be filtered to achieve the effect of purifying the air. In addition, the evaporator 40 further includes a plurality of arc filters 95 installed at the internal periphery of the evaporator 40 as shown in FIG. 6, wherein one arc filter 95 is used for illustrating the invention. In fact, several arc filters 95 can be used to form a circular body as shown in FIG. 10, such that the filter can be replaced from the bottom of the circular hole 35 for cleaning, so as to assure the smooth ventilation of the evaporator 40.

In summation of the description above, the present invention has the following effects and advantages:

1. The fan 50 can be used for producing convections when the evaporator 40 of the present invention is not turned on, so that the machine 100 can be used as a circulation fan.

2. The fan 50 can be used for drawing air in a room into the evaporator 40 through the circular hole 35 when the evaporator 40 is turned on, and then the air is entered into the room from the exhaustion outlet 36 at the external periphery of the concave circular groove 32 to constitute an air-cool convection, so that the machine 100 can be used as an air conditioner, and the air-conditioning system can be a system that uses a refrigerant or ice water.

Figure 1:
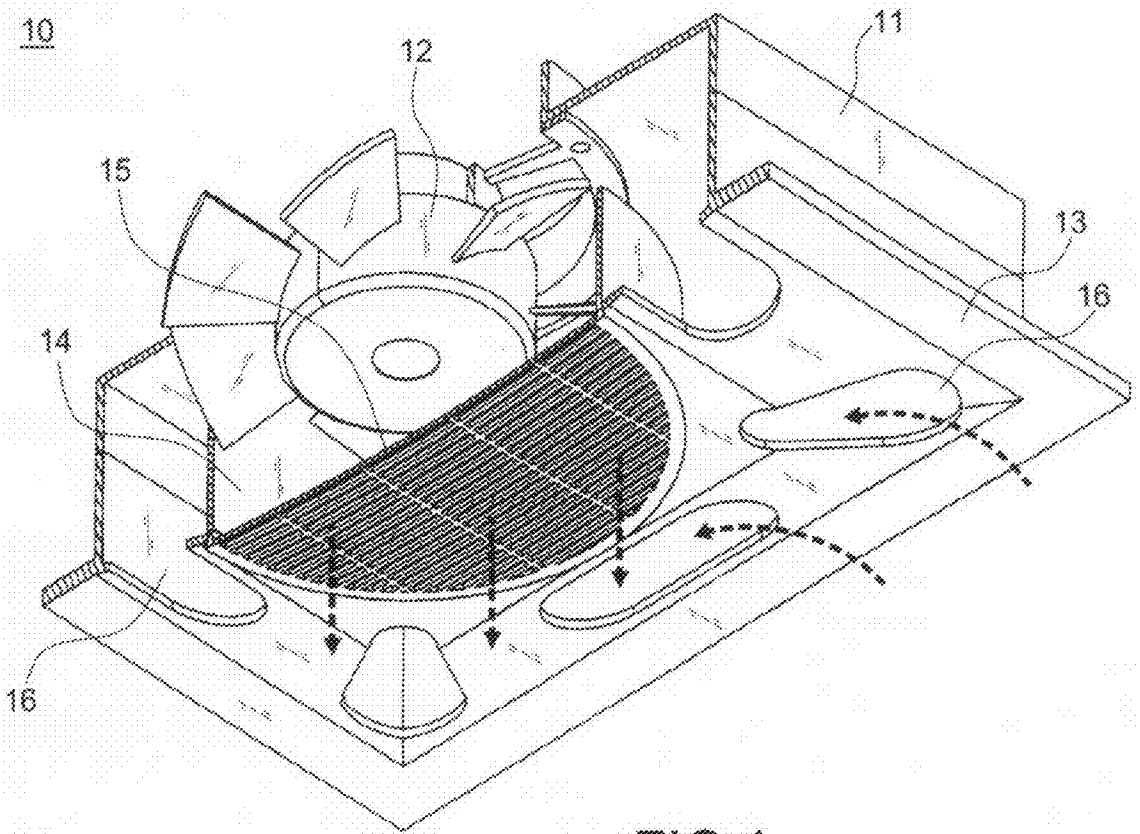
FIG.1 PRIOR ART
FIG. 1 is a schematic view of a conventional circulation fan.
Figure 2A:
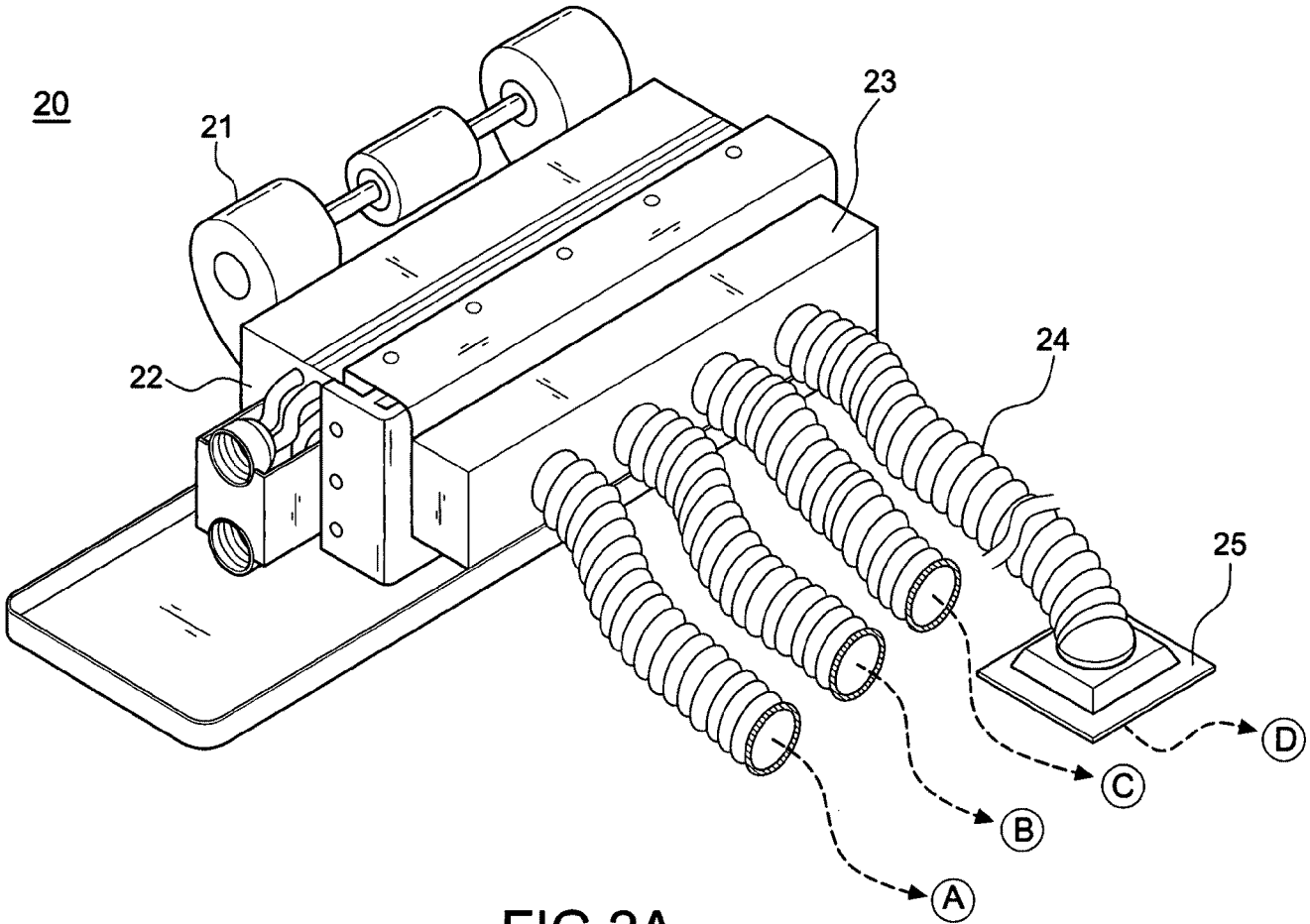
FIG.2A PRIOR ART
FIGS. 2A and 2B are a perspective view and a schematic view of a conventional air-conditioning blower respectively.
Figure 2B:
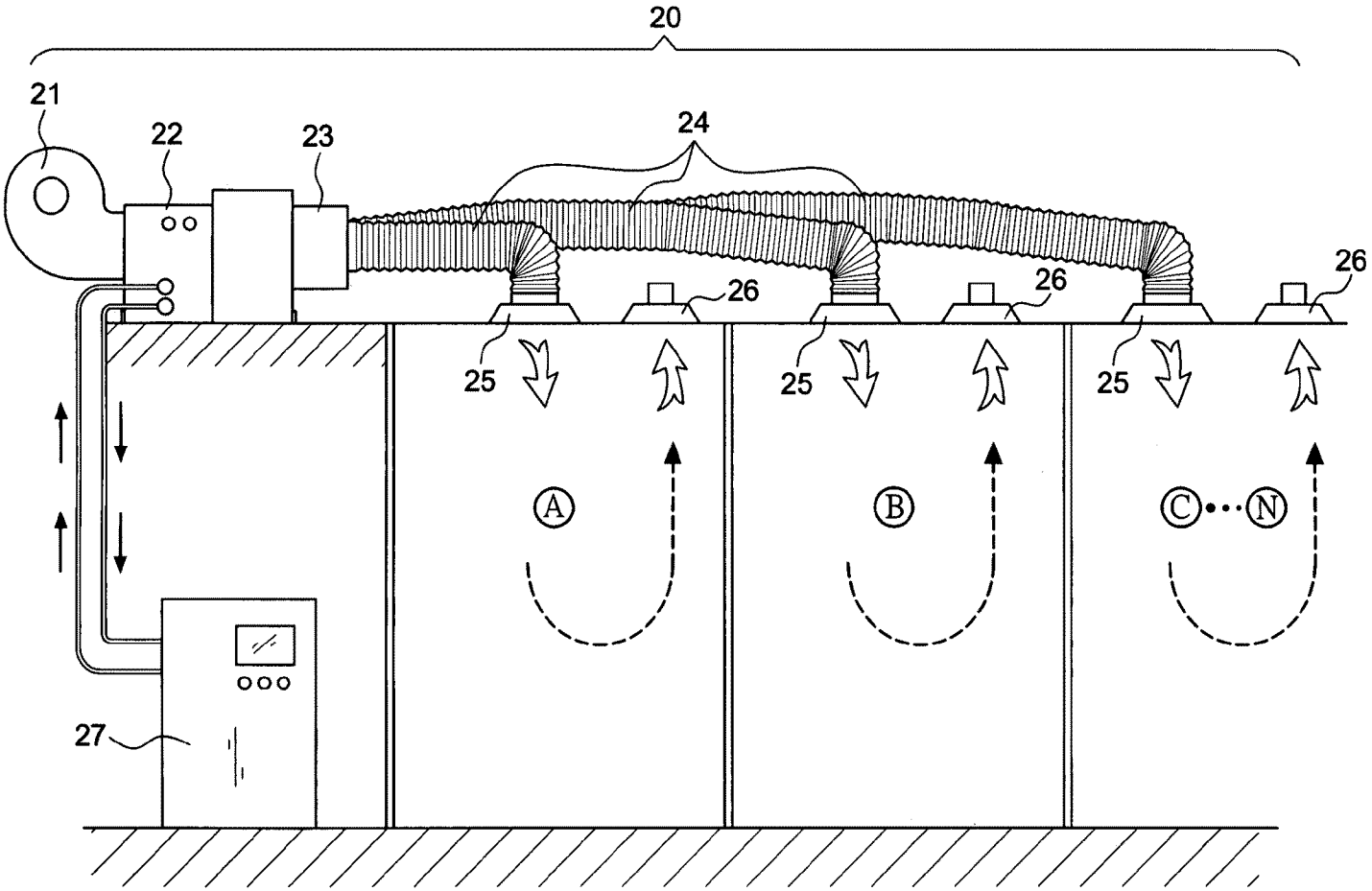
FIG.2B PRIOR ART

3. The exhaustion outlet 36 of the present invention is equivalent to the air outlet 25 as shown in FIG. 2, and the cover 70 is used to replace the conventional air duct 24 and the air box 23, and the circular hole 35 under the fan 50 is used to replace the conventional re-circulation outlet 26, and thus the present invention can integrate the functions of a circulation fan, an air conditioner, an air guide and an air re-circulation into a machine mounted onto a ceiling or a steel frame. In addition, each small area can be used for installing a standalone air conditioner, so that the volume and the weight of the machine can be minimized. The invention not only facilitates the construction, but also provides a flexible way of installing the air conditioners at different positions of the ceiling as needed, and overcoming the loss of cold air due to a too-long air duct, so as to achieve the effects of a convenient installation and improve the efficiency of supplying cold air.

What is claimed is:

1. A multifunctional ceiling air-conditioning circulation machine, installed at a ceiling, and comprising:

a) a base, having a square fixing frame formed around the periphery of the base, a concave circular groove formed at the center of the base, a plurality of exhaustion outlets formed between an internal side of the square fixing frame and an external side of the concave circular groove, and a plurality of ribs formed at the center of the circular hole on an internal side of the concave circular groove for supporting a fan holder;

b) an evaporator, substantially in a circular shape, and installed on the concave circular groove;

c) a fan, installed in the evaporator, and comprised of a motor and a fan vane, wherein the motor is mounted onto the fan holder, and the fan vane is installed in a direction facing upward;

d) a water pump, installed in an extended area on an external side of the concave circular groove, for discharging condensate water dripped from the evaporator to the concave circular groove through a drain pipe to the outside;

e) a cover, covered onto the square fixing frame of the base; and f) a controller, including a control unit and wireless signal receiver, wherein the control unit is electrically coupled to the fan and the water pump for controlling the fan and the water pump to be turned ON or OFF.

2. The multifunctional ceiling air-conditioning circulation machine of claim 1, wherein the evaporator is comprised of a circulation pipe and a plurality of heat dissipating fins, and the circulation pipe comprises an input pipe and a re-circulation pipe, and the input pipe and the re-circulation pipe are coupled to an air-conditioner system at a far end.

3. The multifunctional ceiling air-conditioning circulation machine of claim 1, wherein the water pump includes a liquid level detector installed to a lateral side of the water pump, such that if the condensate water in the concave circular groove reaches a predetermined height, the liquid level detector will send out a signal to turn on the water pump.

4. The multifunctional ceiling air-conditioning circulation machine of claim 3, wherein, the liquid level detector includes a buoy, whose level varies with a water level, for displacing a shaft lever, and the buoy includes a magnet installed therein, and the shaft lever includes a reed switch at a position opposite to the magnet.

5. The multifunctional ceiling air-conditioning circulation machine of claim 1, wherein the cover includes an insulating layer disposed on an internal side of the cover, and the insulating layer is composed of polyfoam.

6. The multifunctional ceiling air-conditioning circulation machine of claim 1, wherein the wireless signal receiver of the controller is installed on the base, and the control unit is installed on an external side of the cover.

7. The multifunctional ceiling air-conditioning circulation machine of claim 1, wherein the controller further includes ON or OFF for controlling the evaporator and the air-conditioner system.

8. The multifunctional ceiling air-conditioning circulation machine of claim 1, wherein the fan holder includes a bearing housing at the center of the bottom of the fan holder for installing a bearing and an axle from top to bottom, and the circular hole of concave circular groove, from bottom to top, contains a guide disc, a joint portion disposed at the center of the guide disc and at a position opposite to the axle, and a bolt for fixing the guide disc at the bottom of the axle from bottom to top, such that the fan holder can be rotated downwardly to a free status, and the guide disc includes a plurality of radial partitioning plates, a plurality of concentric conical circular air guide plates extended outwardly by using the joint portion as a center, and each conical circular air guide plate is arranged with the middle protruded downwardly and the external periphery raised progressively to form an upwardly curved arc shape.

9. The multifunctional ceiling air-conditioning circulation machine of claim 8, wherein the guide disc includes a circular filter mounted onto an internal surface of the guide disc.

10. The multifunctional ceiling air-conditioning circulation machine of claim 1, wherein the evaporator includes a plurality of arc filters mounted onto an internal periphery of the evaporator.

* * * * *